US005820127A

United States Patent [19]

Rodriguez

[11] Patent Number: 5,820,127

[45] Date of Patent: Oct. 13, 1998

[54] ROTATING TRADING CARD APPARATUS AND GAMEBOARD

[76] Inventor: Irma L. Rodriguez, Peter Styvesant Station 432 E. 14th St., New York, N.Y. 10009

[21] Appl. No.: 635,033

[22] Filed: Apr. 19, 1996

[51] Int. Cl.[6] ..... A63F 3/00

[52] U.S. Cl. ..... 273/280; 273/148 A

[58] Field of Search ..... 273/280, 283, 273/284, 148 A, 148 R, 150, 244, 245, 246, 247

[56] References Cited

U.S. PATENT DOCUMENTS

| | | | |
|---|---|---|---|
| 2,992,551 | 1/1961 | Boone | D21/134 |
| 3,492,000 | 1/1970 | Board | 273/134 |
| 4,452,453 | 6/1984 | Daley | 273/243 |
| 4,488,720 | 12/1984 | Cook | 273/280 X |
| 4,591,161 | 5/1986 | Vanderhoof | 273/280 X |
| 4,593,910 | 6/1986 | Font | 273/280 X |
| 5,071,136 | 12/1991 | Lott | 273/259 |
| 5,129,651 | 7/1992 | Tobias | 273/244 |
| 5,145,173 | 9/1992 | Crowder | 273/93 |
| 5,201,525 | 4/1993 | Castro | 273/293 |
| 5,318,299 | 6/1994 | Beaster et al. | 273/280 X |
| 5,407,204 | 4/1995 | Meyers | 273/244 |

FOREIGN PATENT DOCUMENTS

| | | | |
|---|---|---|---|
| 2676934 | 12/1992 | France | 273/280 |

*Primary Examiner*—William E. Stoll

[57] ABSTRACT

A collectable sports card sorter comprising various elements that when assembled form a rotating stadium with a novel game board upon which up to four innovative simulated sports games can be played, including but not limited to, baseball, basketball, football and soccer. Each of the sports games can be played at a level 1 or II, utilize 6-sided, 12-sided and 20-sided dice on which letter designations dictate plays or moves, and the rules for one sports are similarly applicable to the other sports as well. Players may play to win or lose sports trading cards, but the cards themselves are not required game pieces. The sorter can accomodate sports trading cards by individual team players, specific sports teams, divisions, or a combination of sports trading cards for a variety of sports. An add-on accessory feature of the sorter allows the unit to be utilized as a play house for young children, or hobby kit for sports fans of any age.

2 Claims, 12 Drawing Sheets

FIG. 2
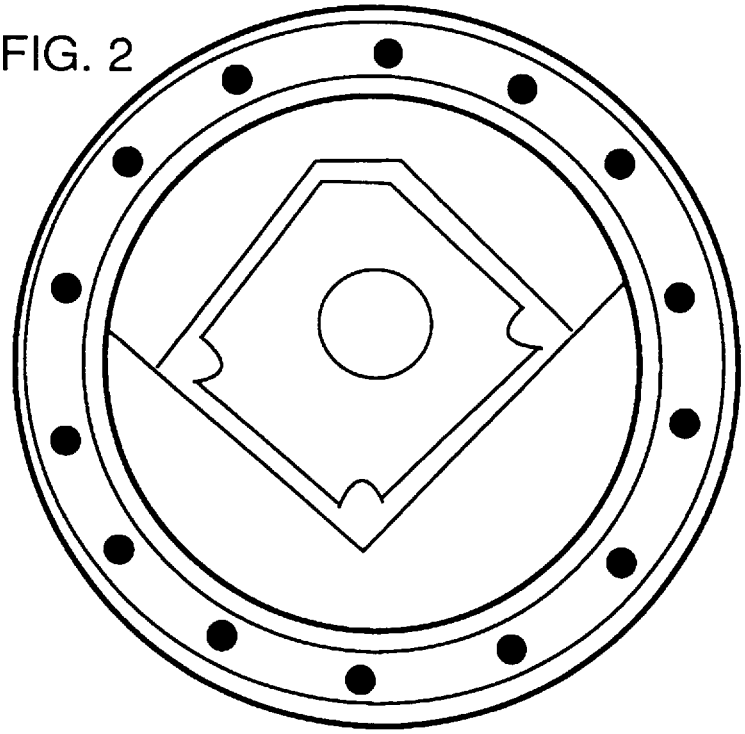
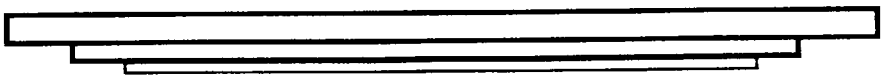
FIG. 3

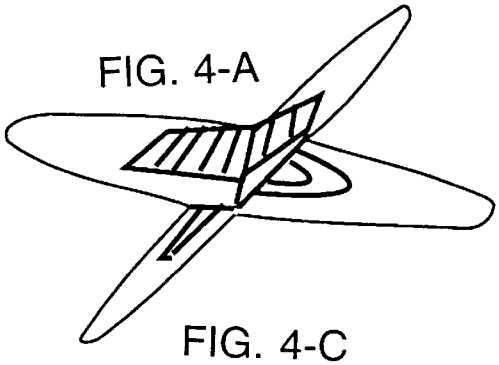
FIG. 4-A
FIG. 4-C
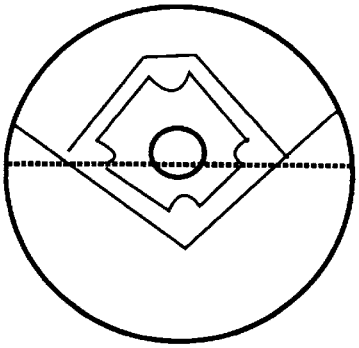
FIG. 4-B
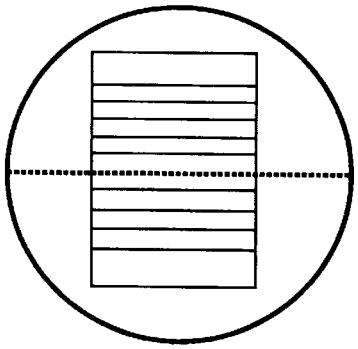
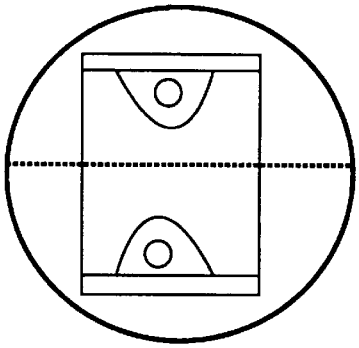
FIG. 4-D
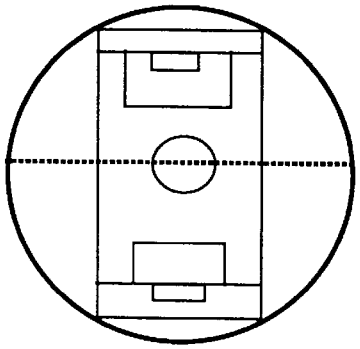
FIG. 4-E FIG. 5-A
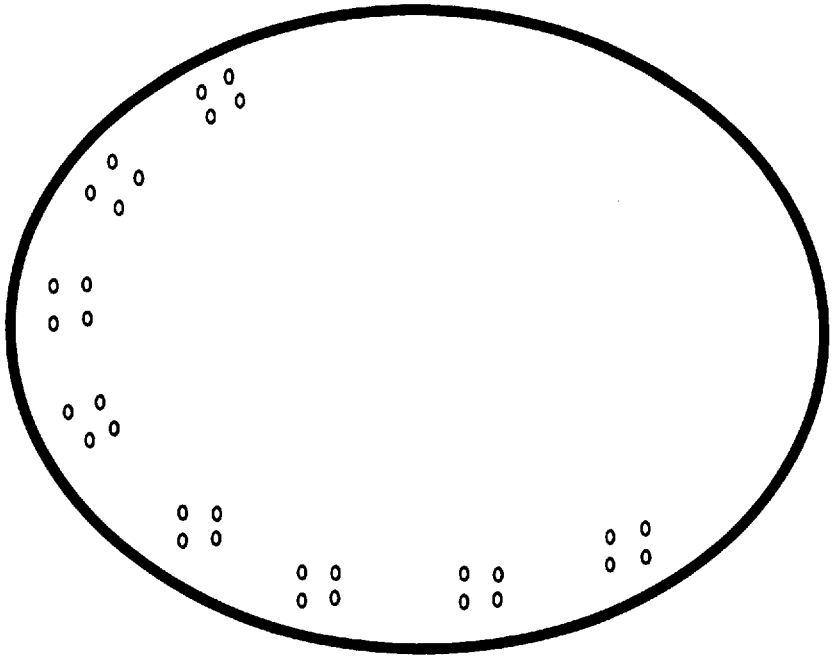
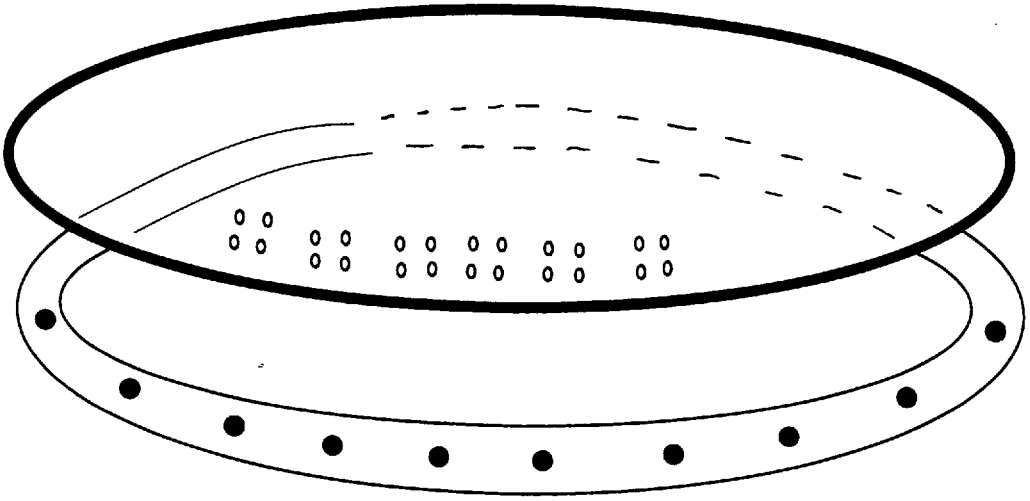
FIG. 5-B FIG. 6-A
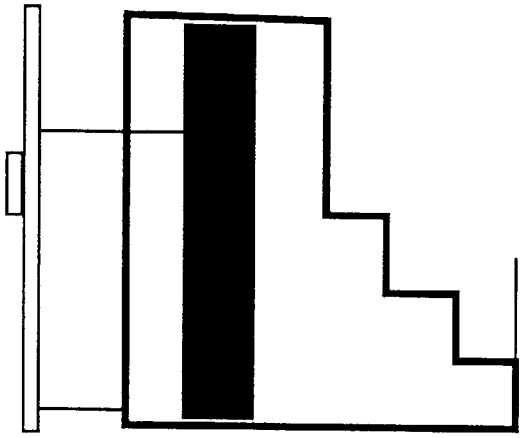
FIG. 6-B
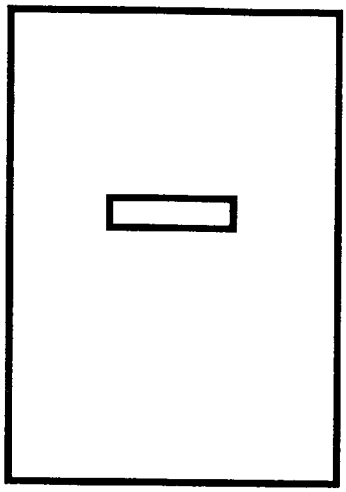
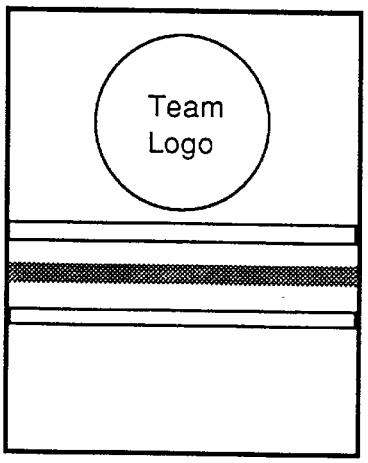
FIG. 6-C
FIG. 6-D
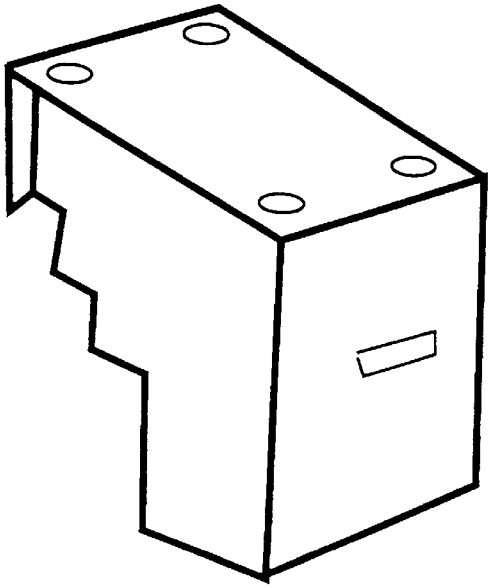

FIG. 6-E
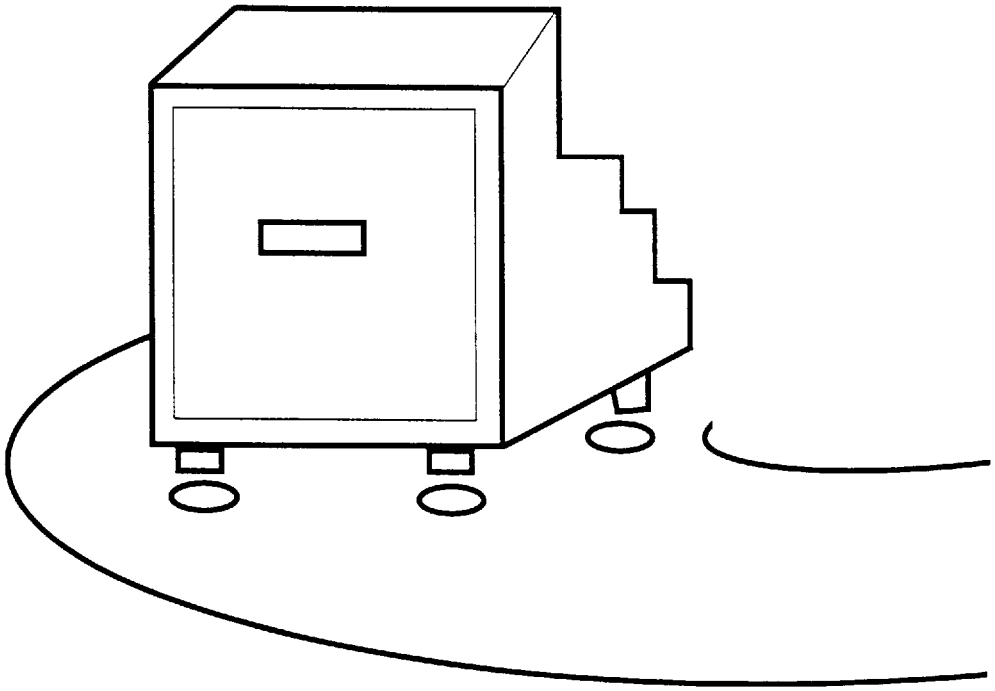

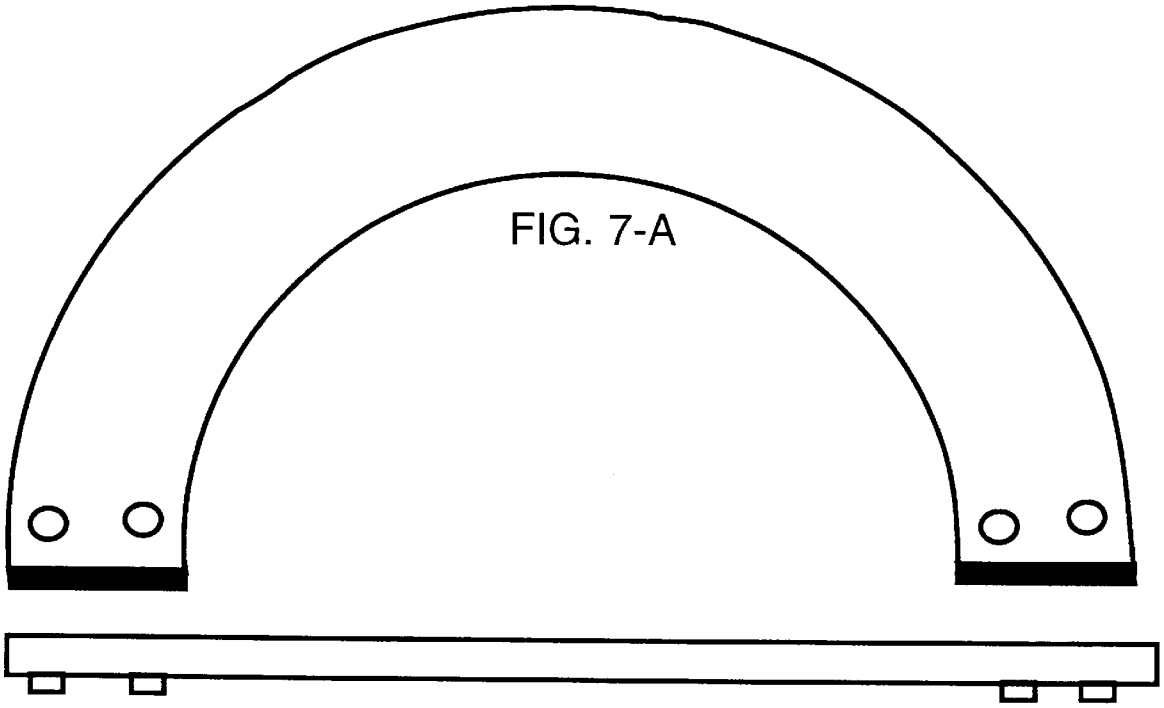
FIG. 7-A
FIG. 7-B

FIG. 9-A
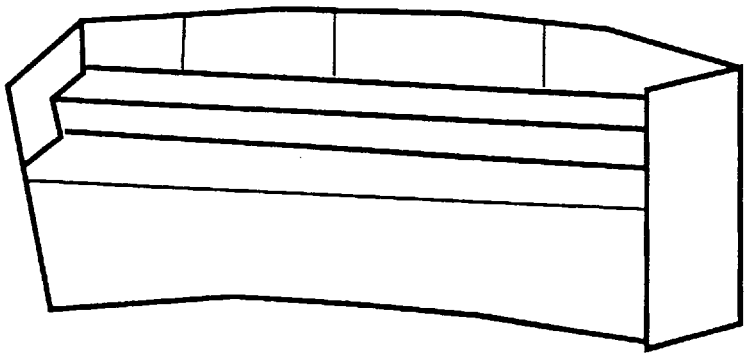
FIG. 9-B
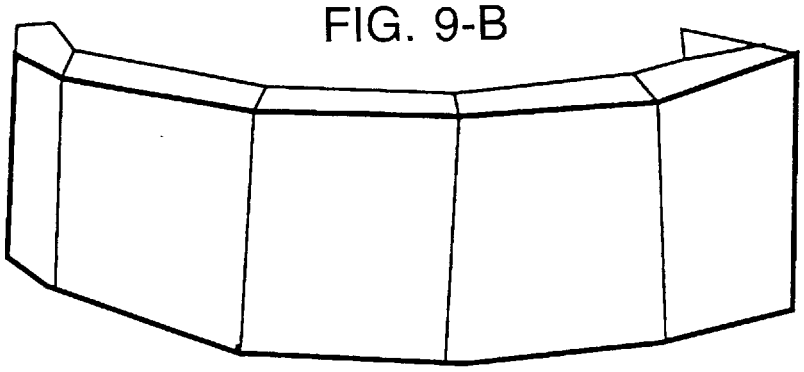

ROTATING TRADING CARD APPARATUS AND GAMEBOARD

BACKGROUND OF THE INVENTION

1. Field of the Invention

The present invention relates to trading cards and more specifically, to a multiple purpose rotating stadium-shaped trading card sorter that includes a novel playing board for playing up to four sports games, including baseball, basketball, football and soccer.

2. Description of the Prior Art

Many simulated sports games have been developed in the prior art for baseball. These baseball games include a baseball playing board and utilize trading cards. For example, U.S. Pat. No. 5,201,525 (Castro, 1992) allows players to lose or win cards by matching them. The cards are protected by card holders. These are placed in a box with an opened cover. In U.S. Pat. No. 5,145,173 (Crowder, 1991) both standard playing cards and baseball player cards are used. Statistics on the back of the card are utilized as an essential component of the game. U.S. Pat. No. 5,071,136 (Lott, 1990) is a collectable sports card board game. This game uses a rectangular coordinates board. It also uses card statistics to gain points and put teams together. The player with the highest points wins the game. U.S. Pat. No. 5,407,204 (Meyer, 1994) utilizes baseball cards. It also uses a card holder to hold a limited number of cards. This card holder is used to position baseball cards during the game. P laying cards are utilized as a specific and required game piece.

Other known prior art games include U.S. Pat. No. 5,390,933 (Kraus, 1993); U.S. Pat. No. 5,435,567 (Compres, 1994); U.S. Pat. No. 4,634,125 (Seklecki, 1984); and, U.S. Pat. No. 5,129,651 (Tobias, 1990).

While these games and devices fulfill their respective, particular objectives and requirements , the aforementioned patents are designed as sports board games that simulate one specific sport. In most cases, the game rules are complicated and geared to a limited target audience (13 years of age and older); require players to be highly knowledgeable of the particular sport; require considerable time to complete the game; use simulated trading cards; contain a single purpose playing board; and moreover, are not designed to be a sports card sorting apparatus. Furthermore, none of the prior art presents an invention which can be assembled to create a sports game multipurpose unit that also embodies the add-on elements of a doll house or electric train hobby kit.

SUMMARY OF THE INVENTION

In view of the limitations and shortcomings inherent in the known types of sports games now present in the prior art, the present invention is a trading card sorter, which together with a number of elements is assembled to simulate a rotating sports stadium and which includes a novel game board upon which multiple sports games, including, but not limited to, baseball, football, basketball and soccer are played. The fully assembled unit provides a way to store, exhibit, position, or sort a plurality of sports trading cards. Trading cards are not used as playing pieces but may be waged as a reward for winning.

More specifically, the trading card sorter rotates 360 degrees for ease of handling, sorting and storing cards. It is composed of at least 28 plastic card holders. When fully assembled, the trading card sorter:

takes the form of a sports stadium that can be custom designed to individual taste;

allows for easy method of sorting and storing a plurality of sports trading cards or team cards, for any sports for which trading cards are manufactured;

can be assembled by anyone eight years of age and older;

includes a novel multiple sports game board upon which up to four sports games can be played;

includes two levels of rules for playing sports games, for the novice as well as the more committed sports fan;

is a 'doll house' for young children, is a 'train set kit' of sorts for hobbyist;

includes a rotating feature which eliminates or significantly reduces the back strain usually associated with other systems of trading card sorting;

is designed to give the game of baseball a popular lift; and provides a game board option for the sport of soccer and other sports.

The sorter utilizes a novel card holder that is attached to a cover base and to individual horse-shoe shaped foundations that help to form a sports stadium. The design of the stadium may vary with individual taste. It can consist of a one level, two or three level stadium depending on the number of holders that are placed on each base or on the type and number of teams in a particular sport.

The plastic card holders are two-sided and serve dual purposes. One side of the sorter consists of a container where cards can be stored and sorted, either by teams or individual players, or in any manner preferred by trading card collectors. The other side of the card holder consists of stadium seats which can be used to place add-on accessories such as miniature pieces representing fans. Additional add-on features such as score boards, press box, batter's bench, etc., enable the invention to embody the elements of a doll house or train set, with which sports novices or enthusiasts can create simple or elaborate stadiums.

The rotating card sorter includes a base upon which is attached a novel one piece flap-type game board. This game board can be easily converted into a sports field that includes, but is not limited to, a baseball, football and soccer field, or a basketball court. This component of the invention allows players to compete for actual trading cards by scoring points in any of the aforementioned sports games.

The purpose of any of the aforementioned games played on the stadium-shaped card sorter is to score the most home runs, basketball shots, soccer goals or touchdown and field goals, respectively. These games can be played at either of two levels depending on the age of the players or how in-depth a player wants to play. A game contains playing pieces pertinent to the particular sport. For example, the pieces for playing a baseball game would consist of a baseball game board, miniature baseball men, each representing a player's preferred team, and a set of dice. The set of dice will include two basic six-sided dice (with standard numbers), one six-sided specially designed die (letter designations), one blank six-sided die, one 20-sided die (letter designations) and one 12-sided die (letter designation). The level 1 game for a particular sports game would require use of the two, standard six-sided die with numbers. The level II game for a particular sports game would require using the remainder of the dice as mentioned above. The game could be played by two to four players.

In a level 1 baseball game, one die would be for the batting team and the other, for the pitching team. Each number on the batter's die represents one of six plays which would include strikes and fouls. The pitcher's die will consist of six different defense plays which allows the pitcher to throw to 1st, 2nd, third, or home, to negate the batters play. A batter who rolls a #2, for example, may go to 2nd base unless the pitching team is able to roll an appropriate counter play that prevent the batting team from taking advantage of his roll of the die. The batting team has three opportunities per inning to score runs. If in three tries, the batting team can not score, his score for inning one will be zero. The players then switch roles with the batting team becoming the pitching team, and the pitching team, the batting team. In cases where there are more than two players, each team will rotate to become batting and pitching team respectively.

Regardless at which level the particular game is played, players have the options of designating team names, number of innings or quarters to be played per game or how long an inning or quarter is. In this manner, a game can be as long or as short as players want it to be. Players can play for points or for trading cards.

The same concept, levels of play and dice apply to a football, basketball soccer or sports game played. The play designations of the die pieces are assigned according to the particular sports game being played. The play designations on the 20-sided dice, for example, would be different for a football game, for a basketball or soccer, and so on. The games played on the game board attached to the sorter can be played by players 8 years of age and up. They can also be novices s or highly knowledgeable in any of the aforementioned sports games. The game presented in this invention allows players to easily learn a variety of sports games. Further elements of the games that can be played on the present invention will be described in full detail shortly.

BRIEF DESCRIPTION OF THE DRAWINGS

FIG. 2 is a top view of the base board plate, with track, that sits on top of the Lazy Susan and upon which the game board will sit;

FIG. 3 is a frontal view of the Lazy Susan and base board plate;

FIG. 4A is a view of the multiple game board upon which four simulated sports games can be played;

FIGS. 4B, 4C, 4D, and 4E is a view of each board game, baseball, football, basketball and soccer, respectively;

FIG. 5A is a plastic cover plate that is placed over the game board to both protect the game board surface and to attach the card holders that in part, make up the stadium shaped card sorter;

FIG. 5B is a perspective drawing that shows how the plastic cover plate is placed over the game board;

FIG. 6A, 6B, 6C and 6D illustrate a side view, back view front view and bottom view, respectively, of the dual purpose card holder;

FIGS. 6E illustrates how the card holder is attached to the plastic cover plate;

FIG. 7A is a side view of the horse-shoe shaped base which is used to add levels to the stadium sorter and which support the card holders;

FIG. 7B is a frontal view of the horse-shoe shaped base;

FIG. 9A is a front view of stadium seats that can be attached at the second level of above of the stadium sorter;

FIG. 9B is a back view of the stadium seats which shows back pockets for inserting and exhibiting up to four individual cards or for holding bid cards;

DETAILED DESCRIPTION OF THE PREFERRED EMBODIMENT

With reference now to the drawings in FIGS. 1–12, a novel trading card sorter with a novel multiple sports game board will be described along with a description of the basic rules for playing the sports games mentioned.

Figure 1:
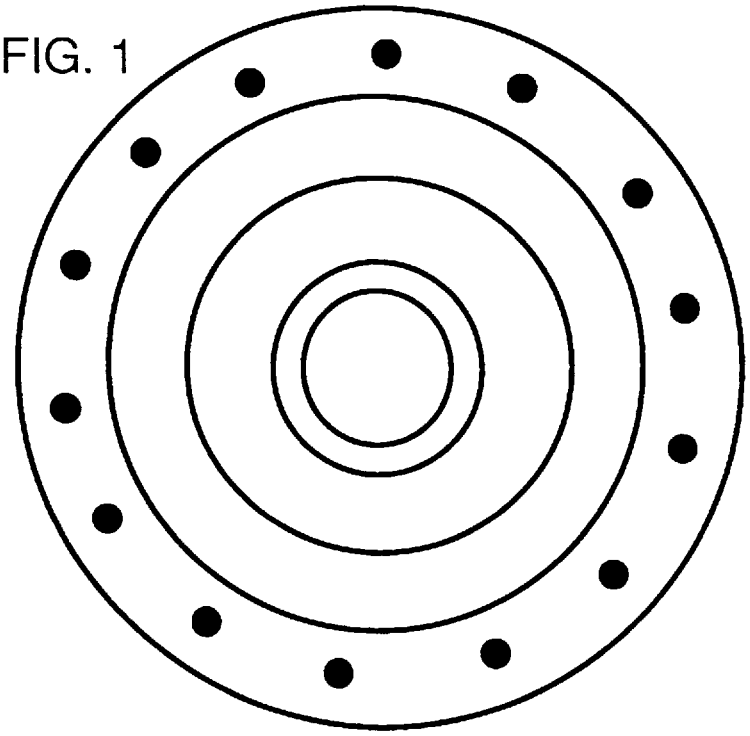
FIG. 1 is a top view of the Lazy Susan base upon which the game board and sorter will sit.
Figure 8:
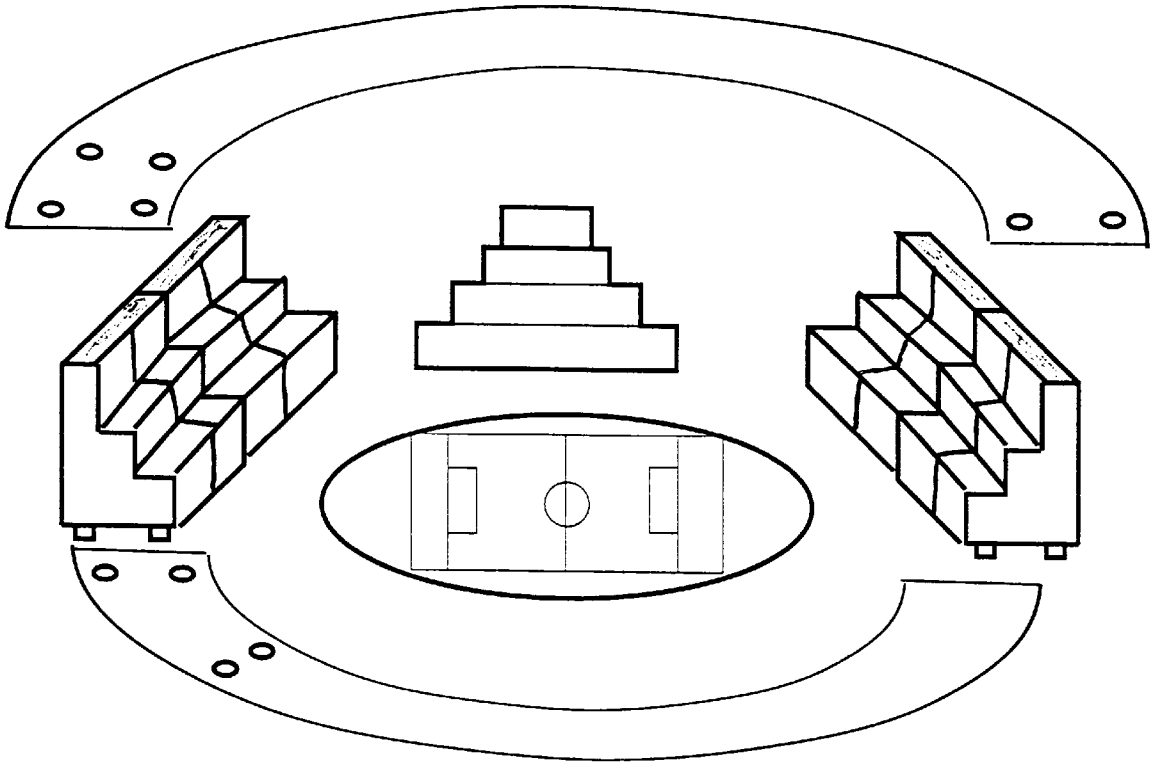
FIG. 8 illustrates how the horse-shoe shaped base sits atop the card holders to hold the card holders in place and to serve as the foundation to assemble another level or tier of card holders.
Figure 10:
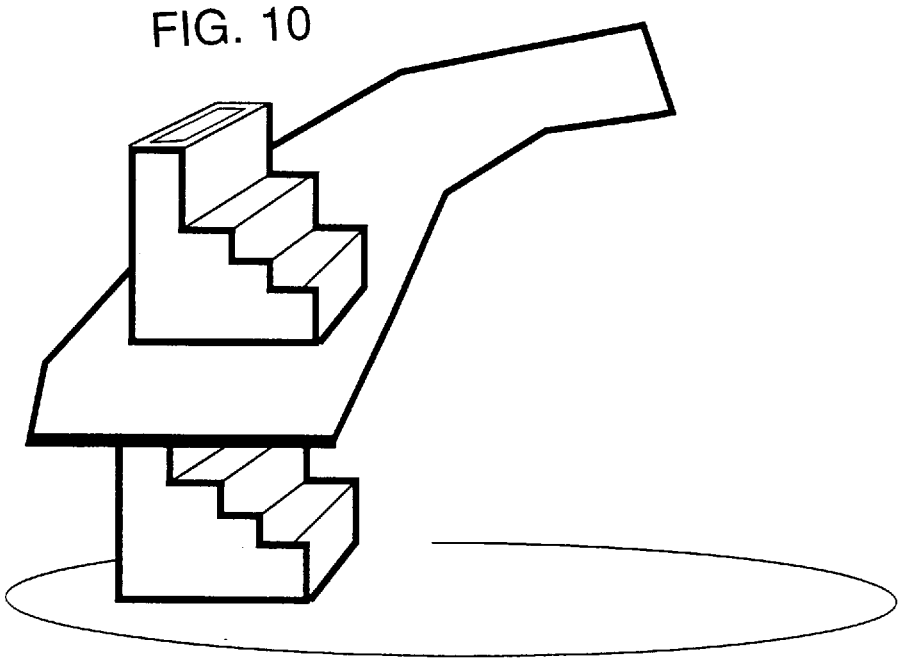
FIG. 10 is a side view showing how the card holders may be stacked to create the stadium design sorter.
Figure 11:
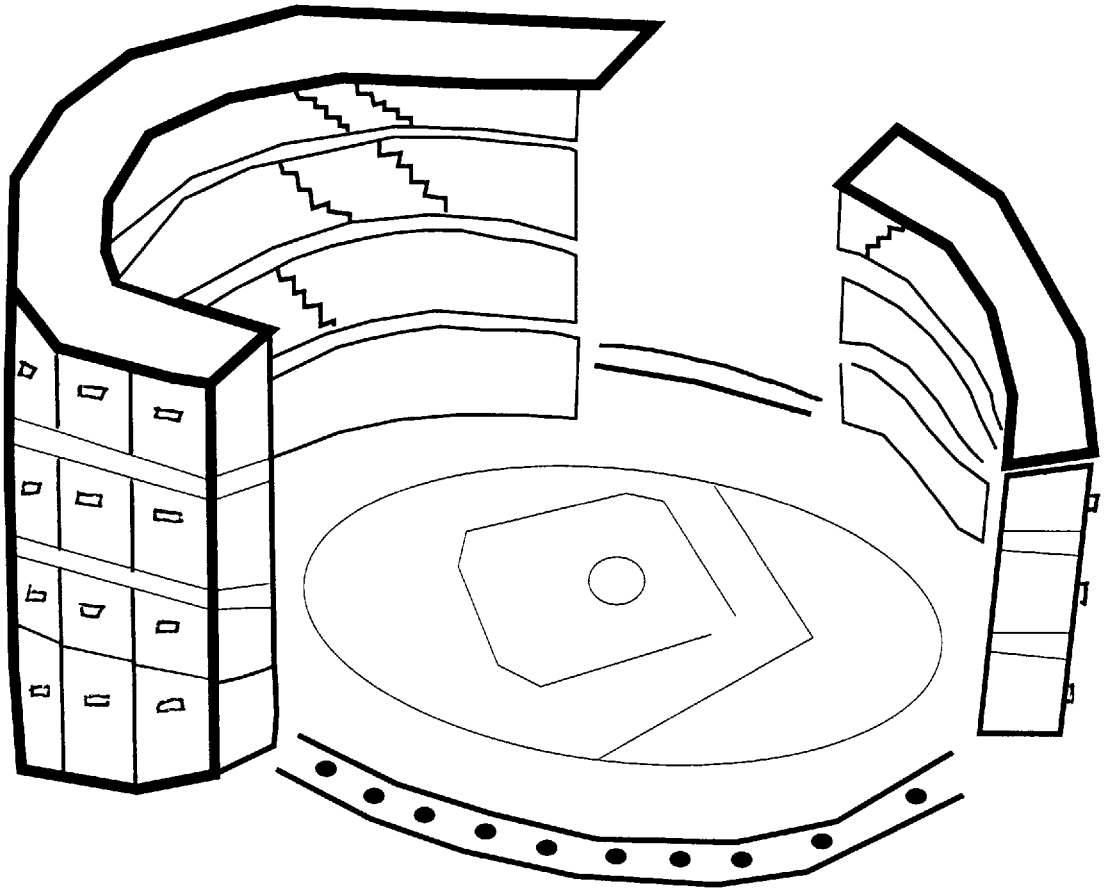
FIG. 11 illustrates a basic stadium sorter design with holders and stadium seats; and, FIG. 12 is an overhead view of the baseball game board and the game pieces.
Figure 12:
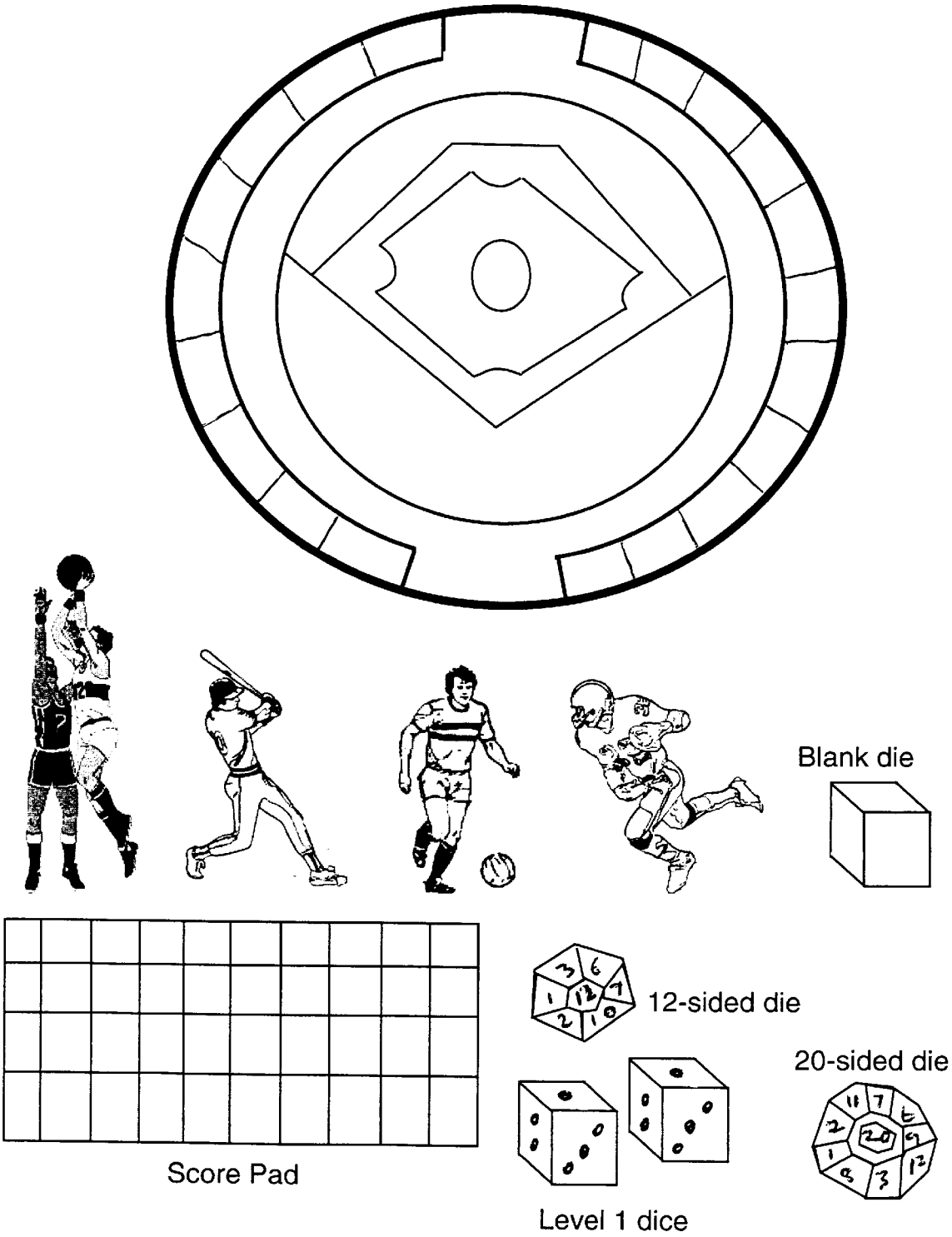

More specifically, note that the sorter, when completely constructed will resemble a basic sports stadium as shown in FIG. 11. The sorter consists primarily of seven basic components as illustrated in FIG. 1 (Lazy Susan), FIG. 2, (game board plate), FIGS. 3–4 (game board), FIG. 5A (plastic cover), FIG. 6A (card holder), and FIG. 7 (horse-shoe shaped level base). Add on accessory pieces provide a more expansive use of the sorter to be not just a card sorter and playing field. Because accessories can be added to the stadium-shaped card sorter and playing field (upon which any number of sports games can be played), the present invention is highly versatile in its use and has popular and marketable appeal. More specifically, the add on features of this sorter, allows the for the assembly of a basic stadium or one more elaborate dictated only by individual taste, and lends itself to incorporate the basic concept of a doll house or train set.

The present invention utilizes a Lazy Susan (FIG. 1) that allows the present invention to rotate a full 360 degrees thereby making it easy to sort or store trading cards. Much of the back strain that is often associated with other sorting methods and mechanisms is significantly reduced or eliminated due to this feature.

The game board plate (FIG. 2) is a turntable that is designed to serve both as a part of the foundation of the trading card sorter, as well as the base upon which the game board is placed. The game board plate (FIG. 2) includes a raised track area that creates a gap which allows the game board to be easily inserted or replaced in the event that players want to switch from a baseball game to a football game without having to take the entire stadium sorter apart.

On top of the game board plate (FIG. 2 ) is a round, plastic cover plate (FIG. 5A ). This plate is the foundation whereby the first level of card holders (FIG. 6A) will sit. Note that holes are punched on this plate. The card holder bottom (FIG. 6) has four pegs that fit into the game board plate (FIG. 2) and therefore affix the card holders to the game board plate. The number of card holders that can be attached per level may vary according to individual preference in stadium designs and is limited to the number of slots available on the game board plate (FIG. 2). However, as will be illustrated shortly, the sorter provides the ability to add a number of levels thereby allowing for additional holders into which additional cards can be stored and sorted.

The card holders of the present invention are novel in that they also serve a dual purpose. One part, as illustrated in FIG. 6A (side view) is a cabinet like encasing whereby individual or team trading cards can be stored and sorted. A knob attached to the exterior part of the card holder (FIG. 6B) and optional team labels pasted on the back of the card holder, provides a convenient and easy method for retrieving or filing baseball, football, basketball or soccer cards. The second component of the card holder is a stadium bench upon which spectator accessory pieces can be affixed. Note that on the seating component of the card holder (FIG. 6A, side view), a hole is punched whereby any spectator accessory pieces may be affixed. The card holder design, together with the rotating feature of the present invention facilitates the task of sorting collectible trading cards for young and old alike.

With reference to FIG. 7A, this horse shoe-shaped base with punched holes provides the means whereby additional card holders or stadium levels can be attached. In this manner, the present invention allows for expanded stadium design options, for placement of sports memorabilia, and ensures that all teams for the aforementioned sports games, both existing and future, are represented.

The open bench compartment illustrated in FIG. 9A may be attached to any of the levels between card holders or may serve entirely as a separate level. This feature is an essential component of the present invention which adds aesthetic value to the stadium. More importantly, it serves a number of purposes with regard to both sorting and the sports games. The open bench compartment of the present invention provides for a narrow pocket in the back of the bench compartment (FIG. 9B) whereby 2–4 individual cards may be inserted. Highly valued cards may be inserted into these pockets solely for storage and exhibition purposes. The pockets can also be used to exhibit miniature product advertisements inserts. With respect to the game, the pockets may serve as a temporary compartment to hold cards which are bid as a prize for winning the most points in any of the aforementioned sports games. In addition, the open bench compartment can serve as a stand to exhibit sports memorabilia such as model sports figures, miniatures of vendors, camera crews, and such accessories which bring the stadium to 'life'. This feature further highlights an additional purpose of the stadium-shaped sorter which is to incorporate the add-on concept of the doll house, model kit, or train set.

The game board (FIG. 4A ) for the present invention is unique in that it can be converted into four different playing fields (FIGS. 4B, 4C, 4D, 4E) while retaining its one piece feature. It consists of two attached circular mats that can be laid flat so that each subsequent side becomes a particular sports field. Each circle is also subdivided as two semicircles which 'flap' over to become two additional sports playing fields. This board is designed to easily and conveniently fit between the game board plate and the game board plastic cover (FIG. A).

An additional purpose of the present invention is to provide a baseball, football, basketball and soccer game that can be played on the aforementioned sports game fields (FIG. 4A). These games are uniquely ideal in that the same basic rules apply regardless of the sports game field utilized. For baseball, basketball, football and soccer, 2–4 people can play. Playing pieces will consist of four miniature players dressed in their respective sport uniforms, each differentiated by color of uniform; a pair of regular six-sided dice; and a score pad. Basic stadium pieces such as a dugout, basketball hoops, goal poles and nets will be standard pieces for each respective sports field. The purpose of each game, regardless of sports game played, is to score the most points, whether it be baseball runs, touchdowns or field goals, baskets, or goals. The winner may simply win points or designated sports trading cards. Players who want to trade cards for points won, must provide their own trading cards.

The baseball game includes level 1 and level 2 rules, one ideal for beginners and occasional fans of the sport, the other, level 2, for mid-level and the commited fan who wants more involvement in the game. The basketball, football and soccer game also provide for level 2 rules and strategies, but will not be presented herein. It is to be understood, however, that the rules and concept of the level 2 baseball game herein described, apply to all the aforementioned sports games listed in the present invention.

In all of the aforementioned games, players will take turns being the defense and offense team. If the rotating holder is used to play a game of baseball, for example, players will be both batter team and the pitcher team at a given turn. This will be accomplished through rotation. Chance, through the throw of the dice by both defense and offense teams, dictates the moves that a player makes. A batting team, for instance, in a game of baseball cannot make his move until the pitching team has had a chance to counter the move. If the pitcher is successful in countering the batting teams play, then the pitching team succeeds in neutralizing the batting teams move. Below is a description of the game rules for playing the aforementioned sports games on the rotating stadium-shaped sorter:

RULES FOR PLAYING BASEBALL, FOOTBALL, BASKETBALL AND SOCCER ON THE ROTATING CARD SORTER

A. Basic Pieces for level 1 sports board game

1. Four miniature players, each wearing distinctive uniforms (Team)
2. Nine miniature baseball players that serve as props and which are positioned in the baseball field. There are also miniature basketball, football and soccer miniature players, which also serve as props and are positioned in their respective spots on the respective sports game board.
3. A pair of regular six-sided dice
4. Erasable custom designed score pad board
5. Trading Cards (optional)

B. The goal for each game is to score the highest number of runs, goals, baskets or touchdowns.

C. The game strategy consist of the offensive team getting one die and the defensive team getting the other. Each number on the die, 1–6, represents a player move. The moves assigned to the offensive team's die differ from the moves assigned to the defensive team's die. The offensive team starts the game by rolling his die. The die will indicate the move that he can potentially make. The offensive team, however, cannot carry out his move until the defensive team has a chance to make a defensive move by throwing his die. If the defense team cannot successfully counter the offensive team's play, the offensive team goes forward with his play. The number of turns a player gets to complete a run, goal, basket or touchdown depends on the particular sports game being played on the rotating sorter. Players can designate how long a game is played determining, for example if the game will last one or more innings (baseball), quarters (basketball and football) or half's (soccer).

I. BASEBALL LEVEL 1 GAME RULES

In addition to the aforementioned information on game strategy and game, pieces, the following discussion presents a basic baseball game to be played on the present invention:

a. Players select respective team and choose team name. One miniature player represents a team.

b. Players decide if they want to play for sports trading cards. They also decide at this point if they want to trade cards per inning, per game or both. By trading both per inning and per game, each player has an opportunity to win or lose cards while the game is in session. If players decide to play for cards, each selects a card or cards that they want to play for. These can be placed on the sorter until the card or cards are lost or won. Players have the option of deciding whether or not to retrieve lost cards by bargaining. For example, players may decide to offer additional cards to regain a lost card. These bargaining sessions are strictly up to the discretion of the players.

c. Each player throws a die to determine order of play. The player who throws the highest number begins the game. This player automatically becomes the batting team. The other player becomes the pitching team.

d. After the first player completes his turns, the pitching team then becomes the batting team and the batting team becomes the pitching team. When the 1st inning is completed, they rotate positions again. When there are more than two players, each player will rotate positions in the following manner: after player one (Team 1) completes his inning, player two (Team 2) becomes the batting team. Player three (Team 3) becomes the pitching team for player two (Team 2). Player three (Team 3) becomes the batting team after player two (Team 2) completes his inning. Player four (Team 4) becomes the pitching team for player three (Team 3). Player four (Team 4) then becomes the batting team and player one (Team 1) becomes the pitching team. Then the rotating system begins again for the second inning, 3rd inning and so on, until the game is completed.

d. Players decide how many innings the game will last (up to nine innings).

e. When players play a game of baseball on the rotating sorter field, the batting team gets three turns to score. However, after each turn, the batting team must allow the pitching team to throw his die to counter the move. The pitching team gets two (2) turns in a row to counter the batting teams first, second and third turn. The pitching team therefore has six (6) total turns to counter the batting team's first inning attempts to score.

Dice No. Designations

| Batting Team | Pitching Team |
|---|---|
| 1-Moves to 1st base | 1. Home Base Throw |
| 2-Move two bases | 2. First Base Throw |
| 3-Strike (Lose a turn) | 3. 2nd Base Throw |
| 4-Moves three bases | 4. Wild Throw |
| 5. Out | 5. Throw to Third |
| 6. Home Run | 6. Fly ball catch |

f. Sample game possibilities for one team playing an inning:

| Batting Team | Pitching Team |
|---|---|
| Rolls a one | Must roll a two or a 6 to get batter out |
| Rolls a two | Must roll a three or a 6 to get batter out |
| Rolls a three | Does not have to counter move. Batting team loses a turn and now has only one more chance to score |
| Rolls a four | Must roll a four or a six. If this is the batting team's last chance to score, batting team is retired in the first inning without scoring. A 'zero' is reflected in the score pad for this player. |
| Rolls a five | Does not have to counter move. Batting team continues with two more turns to score. |
| Rolls a six | Must throw a one or a six to get batting team out. |

g. If the pitching team is not successful in countering the moves of the batting team for this same inning, the following scenario could ensue:

Batting team gets on 1st base on his first turn-Batting team moves to first base Batting team rolls a two on his second turn-Batting team goes to third base because a roll of two on the die tells the batter to move two bases (batter was on first base).

On his third and last turn for the inning, the batter rolls a four. This means that the batter will score at least one run and leaves a man on second. His would score one run for the inning.

Under this same scenario, if a batting player rolls a one in his last try, the batting team scores two runs because he gets the home run as indicated by the die and also brings the batter who was on third, home. At the end of this inning, the batting team would indicate two runs on the score pad.

The basic scoring options used in baseball apply to the present game and additional scenarios with benefits and consequences would be available in a more in-depth instructional booklet for players.

h. If players have designated trading cards for inning winners, the player with the most runs at the end of the inning, would win the card or cards.

h. Players would continue playing through the end of innings previously designated.

BASEBALL GAME RULES: LEVEL 2

The baseball game embodied in the present invention provides two levels of playing. The aforementioned rules and strategy are directed mainly at beginning and the occasional fan and as mentioned, can be played per inning or for an entire nine innings. The following rules and strategy is available for the mid-level and committed fan who may want more involvement in a baseball game board simulated game. The beginner may graduate to this level in time.

Basic pieces

1. One 20-sided die; one 12-sided die; one 6-sided die
2. Nine miniature baseball players
3. Four Teams, consisting of nine distinct players per team, for moving around bases
4. One blank 6-sided die Designation for 20-sided dice:

Six sides are labeled with a "S" meaning a strike

Four sides are labeled with a "B" meaning ball

Four sides are labeled as "PO" meaning Pop-Out

Two sides are labeled as "GO" meaning ground-out

Two sides are labeled as "H" meaning a hit

One side is labeled as "W" meaning a walk

One side is labeled as "F" meaning foul

Designation of 12-sided die:

Six sides are labeled "S" meaning single

Two sides are labeled "D" meaning double

Two sides are labeled "E" meaning error

One side is labeled "T" as triple

One side is labeled "HM" meaning homerun

Designation of 6-sided die:

Three sides are designated as "S" meaning save

Three sides are designated as "O" meaning out

Designation of blank 6-side die:

This die has no role other than to be thrown with the 20, 12 or 6-sided die to satisfy the human habit of throwing two die versus one.

STRATEGY

At start of game, stadium sorter has been assembled. Cards waged to the winner are placed in the bench compartment (FIG. 9). The defense team miniature players are positioned on the game board. The offense team is in the dugout, except for the player for the offense who will start.

1. Teams roll a regular die to decide order of play. Player with the highest number starts.

2. Offense Team leads. He or she rolls the 20-sided die. This throw determines outcome of 'pitching'. Player continues play until he or she gets on base. Player can do this by rolling a "W" (automatic walk to 1st base); rolling four "B's" (balls); or by rolling a "H" (hit). A player rolling an "H" with the 20-side dice would have to do two things before getting on base: a) roll the 12-sided die to determine type of hit. A roll of "E" means that player automatically goes to 1st base or gets an extra base if he or she is already on a base; b) has to allow the defense team to roll the 6-sided die to determine whether the offense is "S" safe or "O" out.

3. Offense team or batting team continues to play until he or she gets three outs. Each team will use their respective nine players to track moves. Team hits, outs, strikes, balls, or homeruns are jotted in the erasable score pad included in the present invention. Then the defense or pitching team goes to bat, in the same rotational manner as described earlier for the level 1 sports games.

II. FOOTBALL GAME RULES

In addition to the aforementioned information on game strategy and game and pieces as indicated in section A–C of Part 2, the rules of the game noted in Part 2, Ia–d also apply to the football game, but where the word baseball is noted, the term football should be substituted; and where the term inning is indicated, the word quarter should be substituted; and where the terms batting team and pitching team are noted, the terms offensive and defensive team should be used instead, respectively. The rules for player rotation also apply to the football game described shortly. The rules following herein are specific to the sports game of football that is played on the present invention.

a. In this board game, the offensive team gets four tries to get a first down as is the case in an actual football game. Each time a first down is accomplished, the offense team continues to gain until such time that he is intercepted, fumbles or is unable to get the ten yards needed to proceed. The defense team tries to counter each attempt made by the offense team to gain yards and to prevent the offensive team from scoring a touchdown or field goal.

b. Dice No. Designations

| Offense Team | Defense Team |
|---|---|
| 1-Gain 10 yards | 1. Intercept |
| 2-Fumble | 2. Gain only half of indicated yards |
| 3-Gain 5 yards | 3. Miss tackle, player proceeds |
| 4-Go to opponents 1 yd line* | 4. Tackled, no gain |
| 5. Gain 40 yards | 5. Missed Tackle, player proceeds |
| 6. Gain 20 yards | 6. Sacked, lose 5 yards |

c. Game strategy: For this game, the throw of the die by the offensive team, and the counter throw for the defense team are generally clear. If an offense team rolls a 1, he can fully gain 10 yards if defense team rolls a 3 or a 5. In all other cases, the offense team can lose the ball (defense team rolls a 1); make no clear gains (defense team rolls a 4); gain only half of the yards indicated by the roll (defense team rolls a 2); or, may be sacked for a loss (defense rolls a 6).

To add some excitement to the game, the number 4 on the offense die instructs the offense team to go all the way to the opponents 1 yard line. In such a scenario, the defense players ignore the die moves as indicated above, and instead will ask the defense team to indicate whether he wants to go for a field goal or for a touchdown. If the offense team elects to go for a touchdown, he must roll a double in order to gain the touchdown. He gets two chances to roll a double. If on the other hand, the offense decides to go for a field goal, the offense player must select a number from 1–6. The defense team player will then roll the die. If the number rolled by the defense team matches the number selected by the offense team, the offense scores a field goal. If the offense team does not get a double or match the number, his turn is up and the next player takes his turn. If the offense team scores a touchdown or a field goal, his turn is also up.

d. Players can decide up front how many quarters make up a game, as well as how long each quarter runs. The player with the most points wins the game, and therefore any cards that may have been offered to the winner of the game.

III. BASKETBALL GAME RULES

In addition to the aforementioned information on game strategy and game and pieces as indicated in section A–C of Part 2, the rules of the game noted in Part 2, Ia–d also apply to the basketball game, but where the word baseball is noted, the term basketball should be substituted; and where the term inning is indicated, the word quarter should be substituted; and where the terms batting team and pitching team are noted, the terms offensive and defensive team should be used instead, respectively. The rules for player rotation also apply to the basketball game described shortly. The rules following herein are specific to the sports game of basketball that is played on the present invention.

a. In this board game, the object of the game is to score as many basket as possible. To simulate the actual fast pace action of a basketball game, the offensive team which begins the play, gets up to two chances to score depending on the number on that die that is rolled. In some cases, an offensive team may get only one turn to score. This is also true for the defense which may get up to two turns to counter an offense move or just one chance depending on the number rolled on the die.

b. Dice No. Designations

| Offense Team | Defense Team |
|---|---|
| 1-Shoots for two points | 1. Shot is blocked |
| 2-Offensive Foul | 2. Ball stolen |
| 3-Shoots for 3 points | 3. Fouls player |
| 4-Slam Dunk | 4. Basket counts |
| 5. Called for walking | 5. Goal Tending called |
| 6. Shoots and misses | 6. Basket counts |

c. Game strategy: For this game, the throw of the die by the offensive team, and the counter throw for the defense team are generally clear. If an offense team rolls a 1, he can score two points if the defense is unable to roll a 1 (shot is blocked) or a 2 (ball stolen). If the defense scores a 1 or a 2, the offense team still has another chance to try to score.

2. The offensive team can negatively impact his own game without the defensive team making a move. For example, if the offensive team rolls a 2, (offensive foul) the offensive team automatically loses his second turn to try to get a basket. This is also true if the offense team rolls a 5 (called for walking).

3. If the defense team rolls a 3 (fouls player), the offense team gets a chance to score an extra 2 points. To do so, the offense team gets three tries to roll a double. If he is successful in rolling a double, he scores three points.

4. When an offense team scores a 4 (slam dunk) there is nothing the defensive team can do to counter this move. The offense team automatically scores two points. However, the offense team does not get a second turn after scoring by means of slam dunk.

5. In the span of a four quarter game, in a game played by more than two players, a team that rolls a 2 (offensive foul) eight times is automatically disqualified from the game.

6. Players can decide up front how many quarters make up a game, as well as how long each quarter runs. The player with the most points wins the game, and therefore any cards that may have been offered to the winner of the game. As in all the other games, players can play for actual trading cards either winner take all at the end of the game, or per quarter.

SOCCER GAME RULES

In addition to the aforementioned information on game strategy and game and pieces as indicated in section A–C of Part 2, the rules of the game noted in Part 2, Ia–d also apply to the soccer game, but where the word baseball is noted, the term soccer should be substituted; and where the term inning is indicated, the word half should be substituted; and where the terms batting team and pitching team are noted, the terms offensive and defensive team should be used instead, respectively. The rules for player rotation also apply to the soccer game described shortly. The rules following herein are specific to the sports game of soccer that is played on the present invention.

b. Dice No. Designations

| Offense Team | Defense Team |
|---|---|
| 1-Pass | 1. Ball is blocked |
| 2-Free Kick | 2. Ball is stolen |
| 3-Pass | 3. Pass goes forward |
| 4-Out of Bounds | 4. Ball goes out of bounds |
| 5. Shoot for Goal | 5. Stops Goal if rolls #5 on die |
| 6. Off sides | 6. Player tripped/try free kick |

c. Game strategy: In this game, teams will play two half's for a designated period of time. As in soccer, scoring occurs infrequently, therefore, the play designations on the die are designed so that a team cannot easily score. The number of turns a team gets, depends on the roll of the die.

| Offense Team | Defense Team |
|---|---|
| 1) rolls a 1 or 3 on turn | Must roll a 1, 2, or 4 to stop offense and become offense team.<br>Rolls a 3, pass goes forward and offense takes another turn.<br>Rolls 5-Not significant unless offense team has also rolled a #5. In such a case, offense scores a goal.<br>Rolls a #6, offense team gets a free kick attempt; scores a goal if he rolls a double in three unopposed turns. |
| 2) Rolls a #2 | Automatically gets a turn to score. Scores if rolls a double in three unopposed tries. |
| 3) Rolls a #4 | Loses ball; defense team becomes offense team. |
| 4) Rolls a #5 | Attempt can be stopped by the roll of a #1, #2, #4 or #5 (defense must roll a #5 on the die to stop the goal or else goal is good.)<br>If #6 is rolled, offense tries for a free kick, as specified above. |
| 6) Rolls a #6 | Offense automatically loses turn and defense becomes the offense team. |

7. In the span of two half's or a full game, in a game played by more than two players, a team that rolls a #6 (player tripped) eight times is automatically disqualified from the game.

8. Players can decide up front whether to play one half or two half's, as well as how long each half runs. The player with the most points wins the game, and therefore any cards that may have been offered to the winner of the game. As in all the other games, players can play for actual trading cards either winner take all at the end of the game, or per half.

These games are easy and fun to play and will help to boost appreciation for sports games, and in particular for baseball which has faltered in the last couple of years due to the strike. In addition, the game of soccer herein described will help elevate and popularize this sport in the U.S. and will give existing fans another way to enjoy the sport. This novel sports board, games and the sorter makes for a complete package that will be easy to market and an enduring product that can be enjoyed by all sports fans.

Although only the preferred embodiment of the game has been described, it is to be understood that all variations and modifications in the embodiment are encompassed thereby are to be regarded as being within the spirit of the invention as defined by the scope of the appended claims.

What is claimed is:

1. A trading card sorting apparatus that becomes a rotating sports stadium wherein multiple sports action games are simulated on a game board, and which comprises;

a) a rotating device with a radius turn of up to 360 degrees upon which a sports field game board is attached;

b) a mounting plate wherein said rotating device is placed;

c) a detachable flap-type, multiple sports game board attached on said mounting plate, for simulating four individual sports games, including, but not limited to baseball, basketball, football and soccer;

d) a protective panel to cover said game board that includes a track, which when said mounting board and protective panel are attached, provides a gap for inserting and removing the game board without dismantling a sorting unit, said protective panel also having punched holes on which a plurality of card holders are attached;

e) a plurality of clear plastic card holders for receiving, displaying, storing and sorting individual and a plurality of sports trading cards, with each said card holder having a frame, card cabinet, knob and an attached section in the shape of stadium seats for accessory attachments and aesthetic value;

f) a horse-shoe shaped base with punched holes wherein additional card holders and accessories are attached.

2. The trading card sorting apparatus recited in claim 1 wherein;

a) each sports game is simulated on one of four separate sports fields of the game board and which comprise;

b) a plurality of player pieces for each sports game simulated on said game board, including miniature players and other playing pieces pertaining to sports games and comprising dugouts, goal posts, goal nets, and bats;

c) an erasable and customed designed score pad for keeping inning, quarter or half time scores of the respective sports game and wherein players decide how long an inning, quarter or half is or how many innings, quarters or halves to play in order to complete a game;

d. a set of regular six-sided dice for level 1 rules wherein each number is designated in the rules as a particular play for each respective sports game, and wherein one six-sided die comprises a certain set of defensive plays and the other six-sided die represents a certain set of offensive plays where in for a game of baseball, the offensive play designations for numbers 1–6 comprise of #1—move to 1st base, #2—move two bases, #3—strike, lose a turn, #4—move three bases, #5—out, and #6—home run; and the defensive play designations for numbers 1–6 comprise of #1—home base throw, #2—first base throw, #3—2nd base throw, #4—wild throw, #5—throw to 3rd, and, #6—fly ball catch; for a game of basketball, the offensive play designations for numbers 1–6 comprise of #1—shoots for two points, #2—offensive foul, #3—shoots for three points, #4—Slam dunk, #5—called for walking and #6—shoots and misses; and the defensive play designations for numbers 1–6 comprise of #1—shot is blocked, #2—ball stolen, #3—fouls player, #4—basket counts, #5—goal tending, and, #6—basket counts; for a game of football, the offensive play designations for numbers 1–6 comprise of #1—gain 10 yards, #2—fumble, #3—gain five yards, #4—go to opponents 1 yard line #5—gain 40 yards, and #6—gain 20 yards; and the defensive play designations for numbers 1–6 comprise of #1—intercept, #2—gain only half of indicated yards, #3—missed tackle, player proceeds, #4—, tackled, no gain, #5—missed tackle, player proceeds, and, #6—sacked, lose five yards; for a game of soccer, the offensive play designations for numbers 1–6 comprise of #1—pass, #2—free kick, #3—pass, #4—out of bounds, #5—shoot for goal, and, #6—off sides; and the defensive play designations for numbers 1–6 comprise of #1—ball is blocked, #2—ball is stolen, #3—pass goes forward, #4—, ball goes out of bounds, #5—stops goal if rolls a #5 on die, and, #6—player tripped, try free kick;

e. play moves are determined by chance throw of the die by both the offense and defense team;

f. players have the option of playing to win points and trading cards per game, inning, quarter and half;

g. wherein accessory game pieces relevant to the specific sports game comprising dugouts, goal nets, basketball hoops, goal post, miniature sports players, bench seats, press box, and cameras are add-ons to complete the stadium sorter;

h. a level 2 set of rules and strategies for aforementioned games, and as described herein for the baseball game, wherein a 20-sided, 12-sided, 6-sided, and blank dice are used to designate offensive and defensive plays where on the 20-sided die, six (6) sides are labeled with a "S" meaning a strike; four (4) sides are labeled with a "B" meaning ball; four (4) sides are labeled as "PO" meaning Pop-Out; two (2) sides are labeled as "GO" meaning ground-out; two (2) sides are labeled as "H" meaning a hit; one (2) side is labeled as "W" meaning a walk; one (1) side is labeled as "F" meaning foul; and where on the 12-sided die, six (6) sides are labeled "S" meaning single; two (2) sides are labeled "D" meaning double; two (2) sides are labeled "E" meaning error; one (1) side is labeled "T" as triple; one (1) side is labeled "HM" meaning homerun; and where on the 6-sided die lettered die, three (3) sides are designated as "S" meaning save and the other three (3) sides are designated as "O" meaning out; and furthermore, where on the blank, six-sided die, a blank has no role other than to be thrown with the 20, 12 or 6-sided die to satisfy the human habit of throwing two dice at once; and i. a set of rules, that with minimal modification, are applicable to each of the sports game for level 1 or level 2 rules of said games.

* * * * *